US012371864B2

(12) United States Patent
Strait et al.

(10) Patent No.: US 12,371,864 B2
(45) Date of Patent: Jul. 29, 2025

(54) SIDE PANEL ASSEMBLY FOR A SNOW PLOW

(71) Applicants: Blake Lloyd Strait, Lowell, IN (US); Lucas Lawrence Strait, Lowell, IN (US)

(72) Inventors: Blake Lloyd Strait, Lowell, IN (US); Lucas Lawrence Strait, Lowell, IN (US)

( * ) Notice: Subject to any disclaimer, the term of this patent is extended or adjusted under 35 U.S.C. 154(b) by 788 days.

(21) Appl. No.: 17/501,740

(22) Filed: Oct. 14, 2021

(65) Prior Publication Data

US 2022/0112674 A1 Apr. 14, 2022

Related U.S. Application Data

(60) Provisional application No. 63/157,373, filed on Mar. 5, 2021, provisional application No. 63/091,668, filed on Oct. 14, 2020.

(51) Int. Cl.
*E01H 5/06* (2006.01)

(52) U.S. Cl.
CPC ..... *E01H 5/066* (2013.01)

(58) Field of Classification Search
CPC ..... E01H 5/066; E01H 5/062; E01H 5/06; E01H 5/065; E01H 5/067; E01H 5/061; E01H 5/063; E02F 3/8155
See application file for complete search history.

(56) References Cited

U.S. PATENT DOCUMENTS

| | | | | |
|---|---|---|---|---|
| 7,100,314 | B1 * | 9/2006 | Jensen | E01H 5/066 37/231 |
| 7,467,485 | B2 * | 12/2008 | Lachance | E01H 5/062 172/264 |
| 7,743,536 | B2 * | 6/2010 | Evans | E01H 5/06 37/231 |
| 8,776,405 | B2 * | 7/2014 | Paonessa | E01H 5/062 37/232 |
| 2022/0136193 | A1 * | 5/2022 | Weihl | E01H 5/067 37/232 |

* cited by examiner

*Primary Examiner* — Christopher J Sebesta
*Assistant Examiner* — Robert E Pezzuto
(74) *Attorney, Agent, or Firm* — K&L Gates LLP

(57) ABSTRACT

A side panel assembly configured for attachment to a snow plow includes a main frame configured to be removably mounted to the snow plow, a main panel connected to the main frame through a vertical hinge, and a bottom panel. The main panel is movable about the vertical hinge between an extended position and a retracted position. The bottom panel is connected to the main panel through a horizontal hinge on a bottom edge of the main panel.

20 Claims, 11 Drawing Sheets

SIDE PANEL ASSEMBLY FOR A SNOW PLOW

CROSS-REFERENCE TO RELATED APPLICATIONS

The present application claims priority under 35 U.S.C. § 119(e) to U.S. Provisional Patent Application Ser. No. 63/157,373 filed Mar. 5, 2021 and U.S. Provisional Patent Application Ser. No. 63/091,668 filed Oct. 14, 2020, the disclosures of which are herein incorporated by reference in their entireties.

BACKGROUND

The present subject matter relates generally to a side panel assembly that attaches to a snow plow. More specifically, the present invention relates to a side panel assembly that extends from one or more sides of the snow plow and includes components that reactively pivot and/or rotate to accommodate the contouring of the ground surface, allowing the outer edges of the plow to follow the surface of the road for more effective snow removal.

During wintry conditions, a snow plow connected to a drive vehicle is typically used to remove snow from roads and parking lots to improve driving conditions. Conventional extensions or side panels may be attached to one or both sides of the snow plow to increase the width of the plow. Such extensions may be angled so as to direct the snow inwardly toward the middle of the snow plow.

However, while a main and/or central driving path is typically free and clear of debris, obstacles or debris typically located at the outer edges of a driving path often interfere with the snow removal along the main driving path. Conventional extensions are unable to overcome the obstacles or debris along the outer edges of the driving path, forcing the driver of the vehicle to either stop plowing to address the obstacle or reverse the vehicle and drive around the obstacle. Similarly, curbs and other road-related obstacles can be hard to see in snowy conditions. Accidentally steering into or otherwise hitting one or more of these obstacles with a plow extension can significantly damage a plow and/or its extension.

Accordingly, there is a need for a side panel attachable to a snow plow that adapts to accommodate accidental and incidental contact with debris and/or obstacles without damaging the snow plow and without interfering with the snow plow's ability to remove snow along the main path, as described herein.

SUMMARY

To meet the needs described herein and others, the present disclosure provides a side panel assembly with sufficient flexability/adaptability to allow for the extension surfaces of a snow plow to clear obstacles without the need to stop plowing, alter a course of plowing, or damage the plow.

In the embodiment(s) described herein, the side panel assembly can include first and second side panels attachable to first and side sides of a snow plow, respectively. Each side panel includes a main frame, a main panel rotatable about the main frame, and a bottom panel hingedly connected to the bottom of the main panel. Each side panel further includes a cutting edge within the bottom panel that rotates about a pivot. The combination of hinged connections and/or pivots allows for the components of the side panel assembly to easily adjust to the contour of the outer edges of the road surface and to clear obstacles in the path of the snow plow when hit.

More specifically, the main frame is mounted, or otherwise attached, to a support structure of the snow plow. The main frame includes slotted connections that allow the main frame to shift and/or rotate about a point of attachment. The main frame is configured to shift along the slotted connections in response to the side panel assembly following the contour and/or topography of the ground surface.

The main panel extends from the main frame along a hinged connection, such as a vertical hinged connection, for example, and the movement of the main panel is controlled by a hydraulic cylinder positioned behind the snow-contacting and/or plowing surface of the snow plow. The position of the hydraulic cylinder on a rear surface of the snow plow maximizes the available degrees of rotation of the main panel about the hinged connection.

The bottom panel includes a bottom panel frame that receives a cutting edge that strikes the ground surface to remove snow and/or ice therefrom. In various instances, the bottom panel has first and second parallel members defining a slot. The slot is configured to receive at least a portion of the cutting edge therein. The bottom panel is configured to rotate about an axis (the bottom panel axis) aligned with a bottom surface of the main panel. The bottom panel is urged into a vertical position by a spring mechanism; however, any suitable mechanism(s) for moving the bottom panel is envisioned. The cutting edge is replaceably connected to the bottom panel frame of the bottom panel at a pivot point. The cutting edge is configured to rotate about an axis (the cutting edge axis) of the pivot that is substantially transverse to the bottom panel axis. During use, the bottom panel is biased against the spring mechanism and/or the cutting edge rotates about the pivot when the bottom panel strikes and/or encounters an obstacle that extends above the contour of the ground surface.

As described throughout the disclosure, the movement of the various elements of the system occur as a result of the side panel assembly adjusting to the contour of the road surface. The stiffness and responsiveness of the various springs, hydraulics, and other elements that control the movement of the various components can be tuned to appropriately respond to the environmental forces that impact the performance of the snow plow. For example, the snow plow elements should be held in place against reasonable loads of snow, but should be able to pivot to a safe position when impacted by an immoveable object such as a curb.

An object of the invention(s) disclosed herein is to provide a solution for effectively clearing obstacles and/or effectively scraping a ground surface while plowing through the use of one or more extensions, or side panel assemblies, that include multiple points of adjustability and/or rotation.

One advantage of the invention(s) disclosed herein is that the bottom surface of the side panel assembly can adjust to the contour of the road and/or any encountered obstacle, enabling constant operation of the snow plow and/or closer contact with the road surface. Such constant operation of the snow plow and/or closer contact with the ground surface allows for more effective removal of snow and/or ice.

A further object of the invention(s) disclosed herein is to prevent damage to the snow plow, damage to surrounding objects, and/or injury to a person that may be caused as a result of a snow plow abruptly striking an obstacle or debris during use. Without the flexibility and/or adjustability of the side panel assembly disclosed herein, such obstacles or debris can become a projectile object upon contact with a rigid snow plow. Use of a side panel assembly that has the flexibility and/or adjustability to overcome debris and other obstacles along the outer edges of the snow plow path prevents unnecessary damage and/or injury that may be otherwise caused by such debris as the side panel assembly is able to avoid contact with such obstacles.

Additional objects, advantages and/or novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawings figures depict one or more implementations in accord with the present concepts, by way of example only, not by way of limitations. In the figures, like reference numerals refer to the same or similar element.

DETAILED DESCRIPTION

Figure 2:
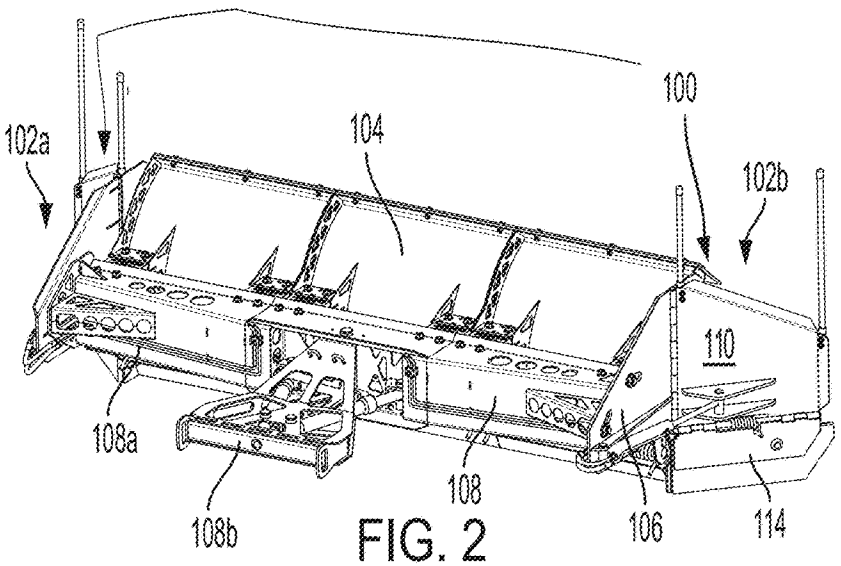
FIG. 2 is an isometric view from a back side of the side panel assembly as shown in FIG. 1.
Figure 1:
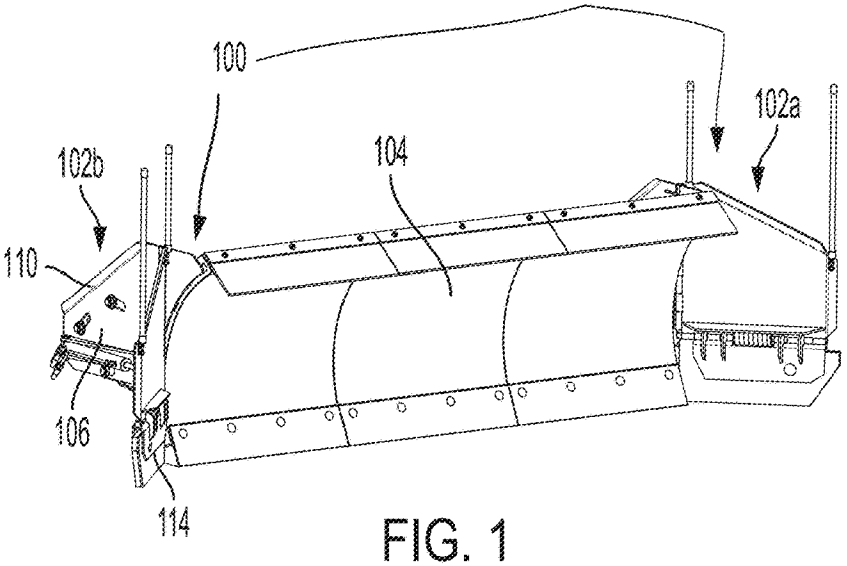
FIG. 1 is an isometric view from a front side of a side panel assembly on a snow plow of the present application.

FIGS. 1 and 2 illustrate an example of a side panel assembly 100 configured to be attached to a snow plow 104 of the present application. As shown in FIG. 1, the side panel assembly 100 includes first and second side panels 102*a*, 102*b* attached to first and second sides, respectively, of the snow plow 104. The snow plow 104 is mounted onto a structural support 108, which is attached to the front of a truck or other vehicle (not shown). The structural support 108 includes a lateral member 108*a* to which the snow plow 104 is mounted and a hitch 108*b* for mounting to the vehicle.

Figure 3A:
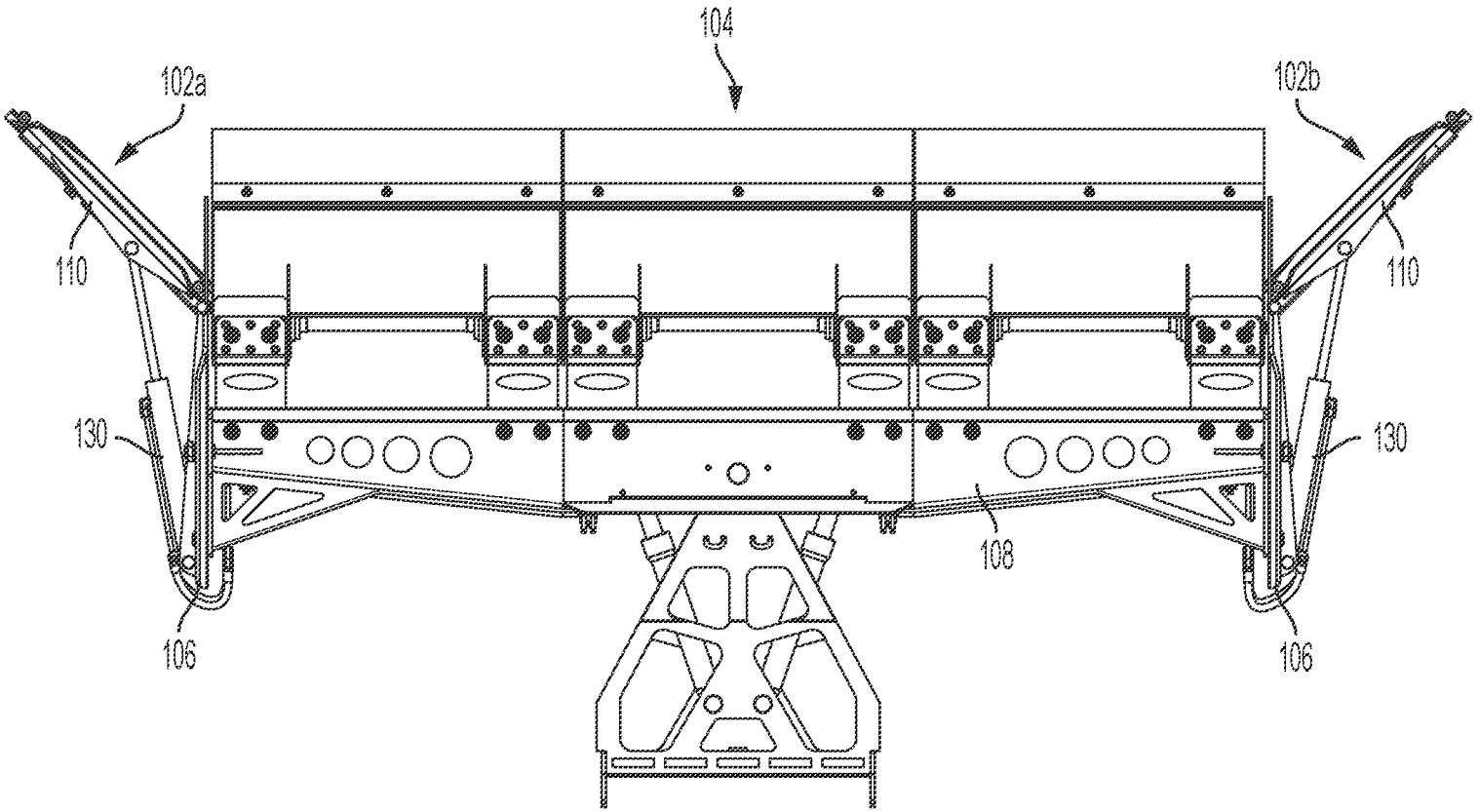
FIG. 3A is a plan view of the side panel assembly of FIG. 1 in a fully extended position.
Figure 3B:
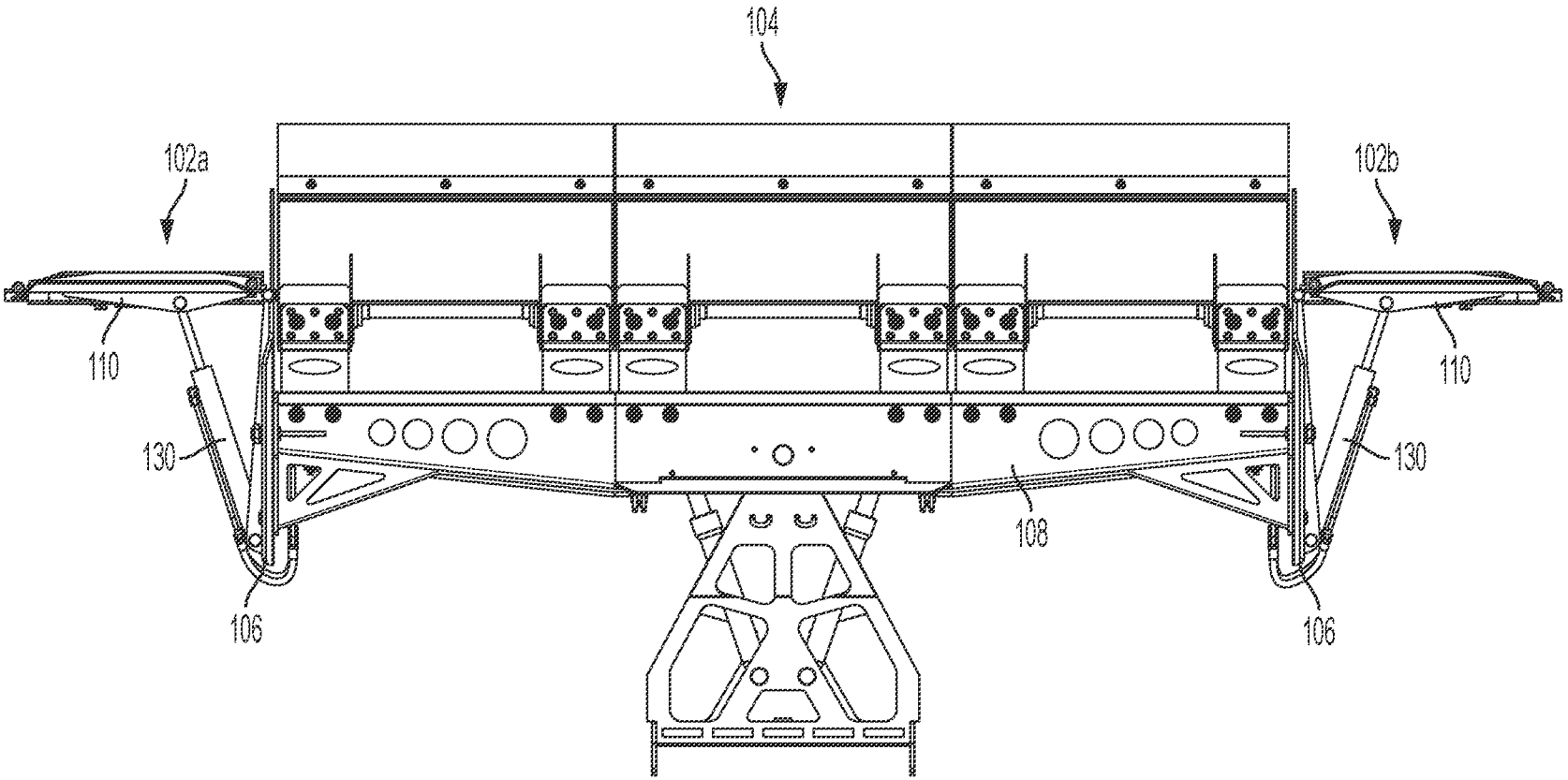
FIG. 3B is a plan view of the side panel assembly of FIG. 1 in a partially extended position.
Figure 3C:
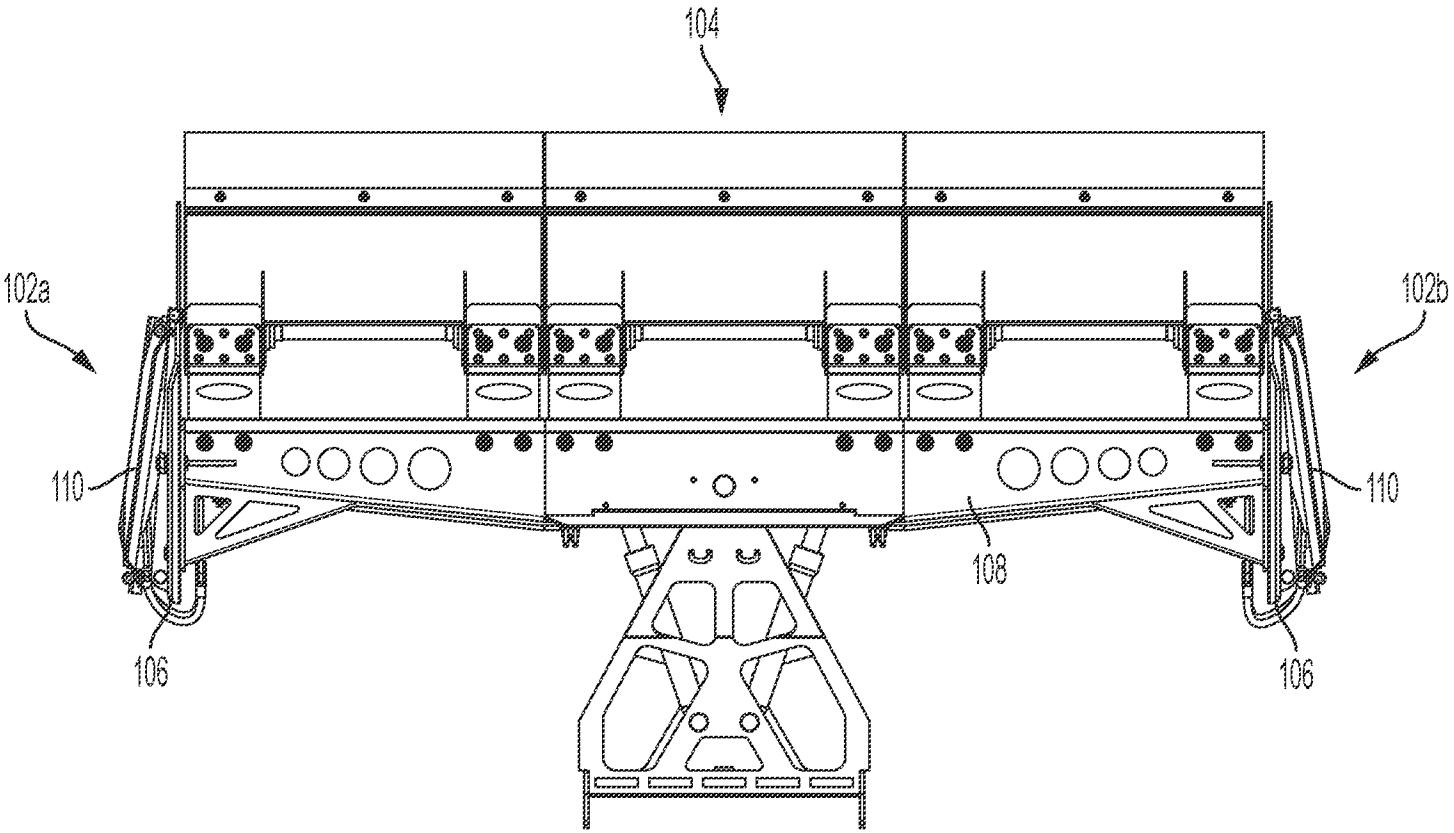
FIG. 3C is a plan view of the side panel assembly of FIG. 1 in a fully retracted position.

Referring to FIGS. 3A-3C, the side panels 102*a*, 102*b* move relative to the snow plow 104 through a range of positions including between a fully extended position shown in FIG. 3A and a fully retracted position shown in FIG. 3C. In various instances, the side panels 102 are configured to move relative to the snow plow 104 into positions, or orientations, other than those illustrated in FIGS. 3A-3C. For example, the side panels 102*a*, 102*b* may move more forward and/or more rearward than is shown in FIGS. 3A-3C. In various instances, only a first side panel 102*a* is attached to the snow plow 104 or only a second side panel 102*b* is attached to the snow plow 104.

Figure 4B:
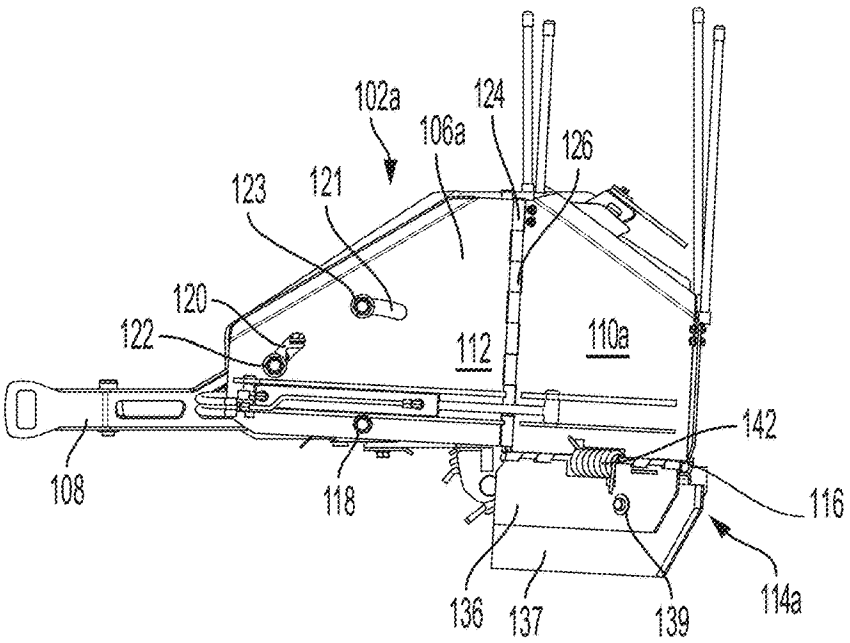
FIG. 4B is an isometric view of the side panel of FIG. 4A in a downward position.
Figure 4A:
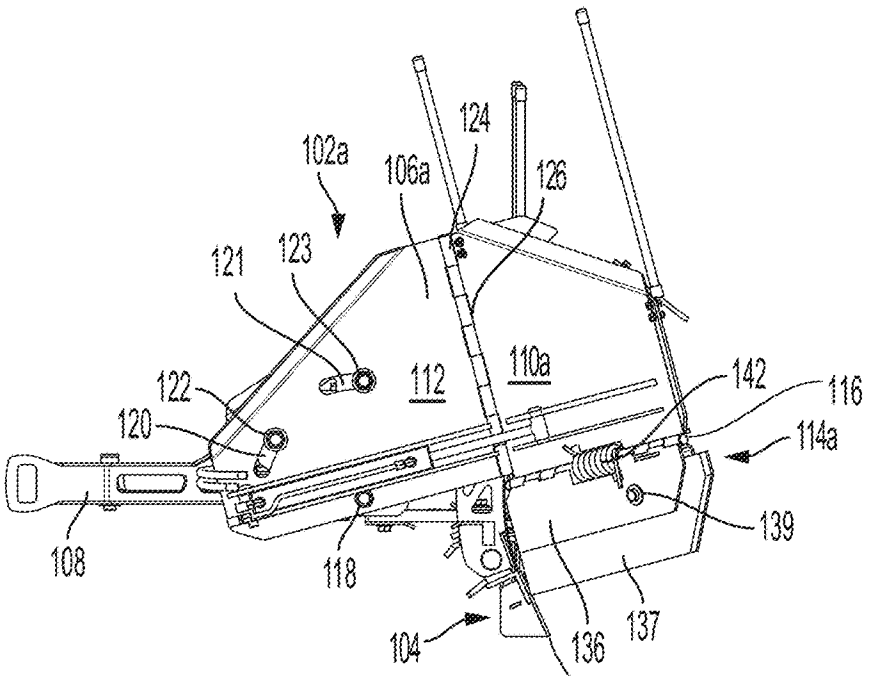
FIG. 4A is an isometric view of a side panel of the side panel assembly of FIG. 1 in an upward position.

Referring to FIGS. 4A and 4B, each side panel 102*a*, 102*b* includes a main frame 106*a*, 106*b* (generally "106") configured to be mounted to the snow plow 104. In various instances, the main frame 106*a*, 106*b* is configured to be mounted to a structural support 108 of the snow plow 104. The side panel 102*a*, 102*b* further includes a main panel 110 that connects to a side surface 112 of the main frame 106*a*, 106*b* through a hinged connection 124 and a bottom panel 114 that connects to the main panel 110 along a bottom edge 116 through a hinged connection. For purposes of discussion, the snow plow 104 and side panel assembly 100 will be described with respect to an X, Y, Z coordinate system, with the width of the snow plow 104 extending along the X-axis, the structural support 108 of the snow plow 104 extending along the Y-axis, and the height of the snow plow 104 extending along the Z-axis.

The main frame 106 is a planar surface extending along the Z-axis with a width that is roughly parallel to the structural support 108 of the snow plow 104, as shown in FIG. 2. In the illustrated embodiment, the planar surfaces of the main frames 106*a*, 106*b* of the first and second side panels 102*a*, 102*b* are parallel, although in other embodiments, the main frames 106 may be angled relative to each other and/or the structural support 108. Further, the planar surface of the main frame 106 includes an angled top edge, although the top edge may include any suitable shape or contour.

Referring to FIGS. 4A and 4B, the main frame 106 is attached to the structural support 108 via one or more threaded rods 118, 122, 123. Although shown and described herein as "threaded rods," it is understood that these attachment elements may embodied in various forms including threaded and unthreaded rods, pins, etc. A first threaded rod 118 provides a pivot point about which the main frame 106 pivots. In the depicted embodiment, the main frame 106 includes two angled slots 120, 121 through which second and third threaded rods 122, 123, respectively, extend, allowing the main frame 106 to rotate about the first threaded rod 118 while remaining restricted by the second and third threaded rods 122 within the respective slots 120. Such rotation moves the main and bottom panels 110, 114 between an upward facing direction shown in FIG. 4A and a downward facing direction shown in FIG. 4B.

In other embodiments, the main frame 106 is attached to the structural support 108 via a bolt or other connector instead of the threaded rod 118. In various instances, the main frame 106 may attach to the snow plow 104 through other suitable means that allow for the main panel 110 to adjustably move between upward and downward facing positions.

The main frame 106*a*, 106*b* may be configured to rotate about the first threaded rod 118 in response to the side panel 102*a*, 102*b* adjusting to the contour of the road surface.

Figure 5A:
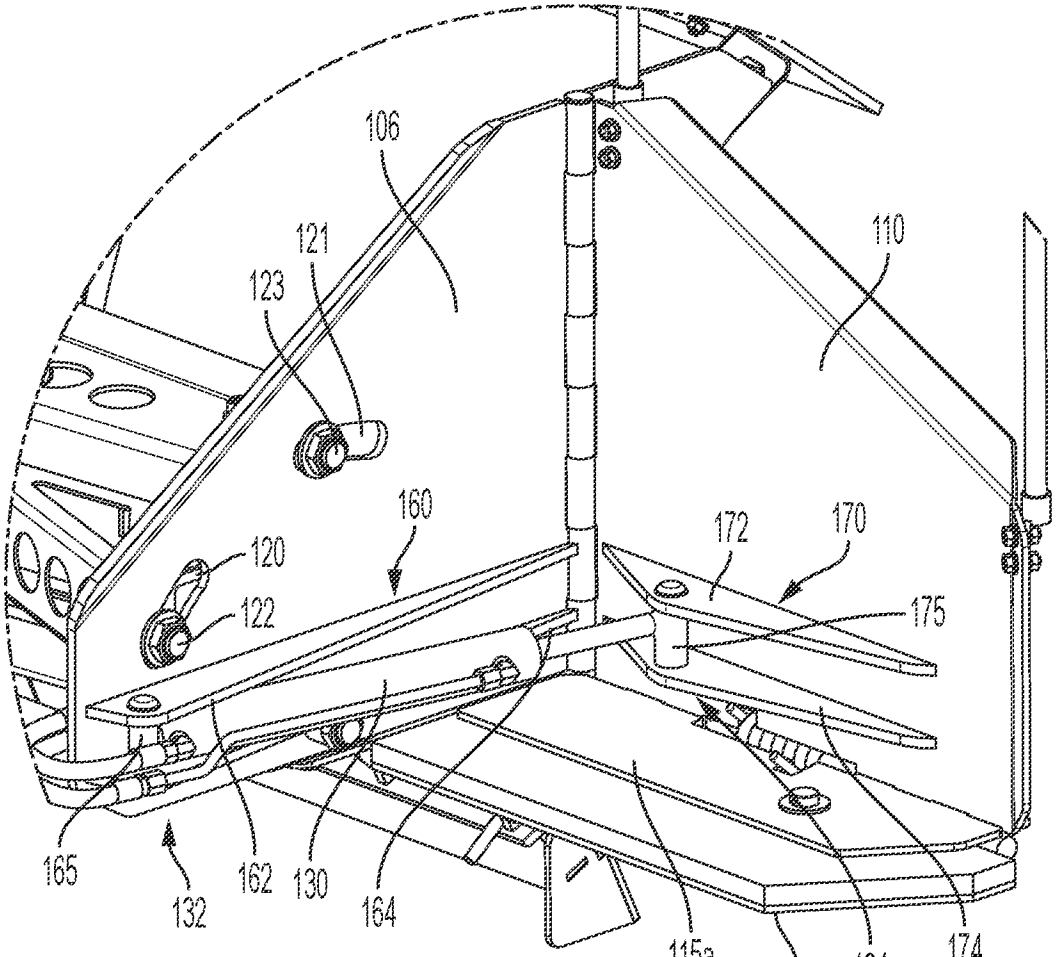
FIG. 5A is an enlarged, rear, elevational view of the side panel of FIG. 5.
Figure 5:
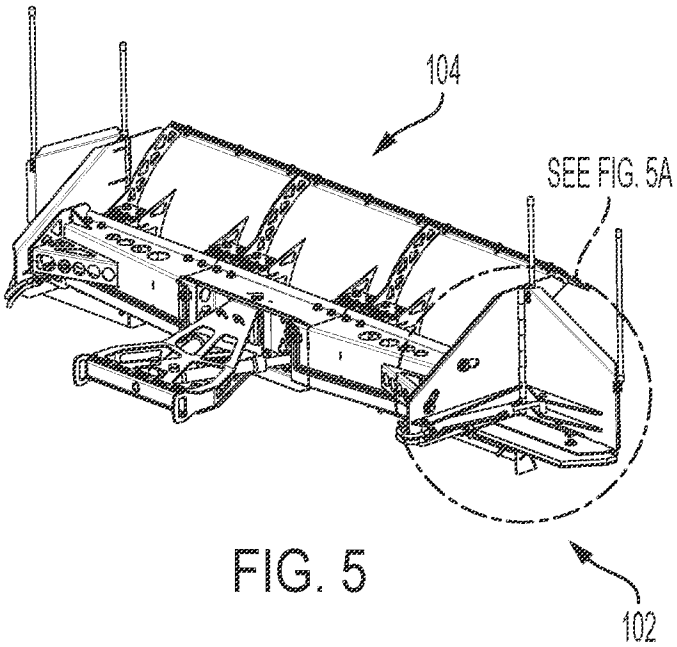
FIG. 5 is a rear perspective view of a side panel of the side panel assembly of FIG. 1.
Figure 6A:
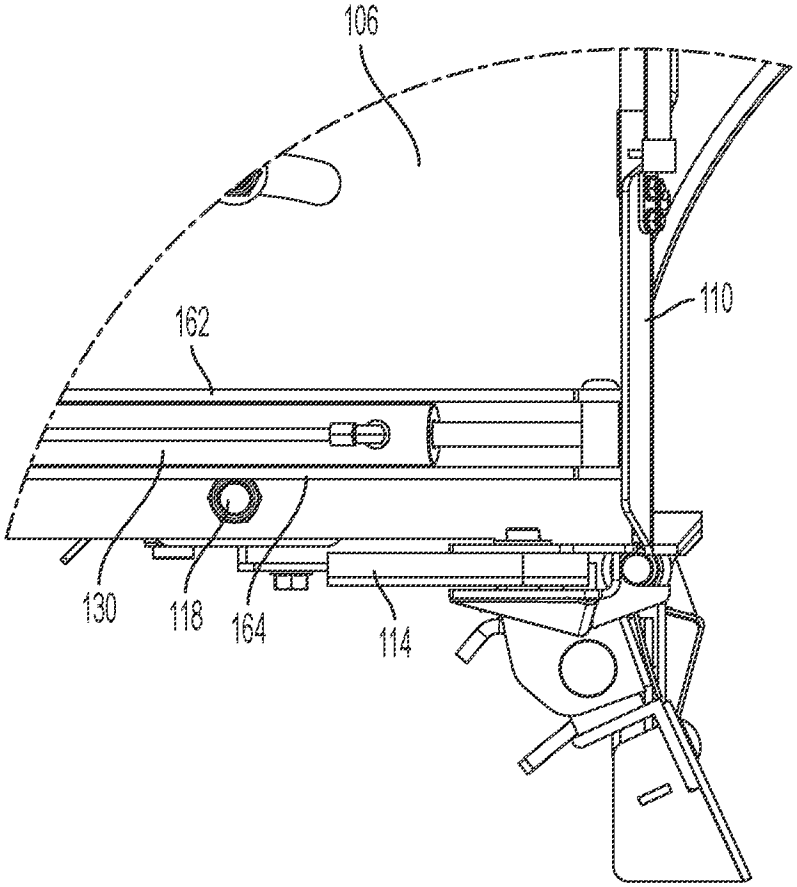
FIG. 6A is an enlarged, side, elevational view of the side panel of FIG. 6.
Figure 6:
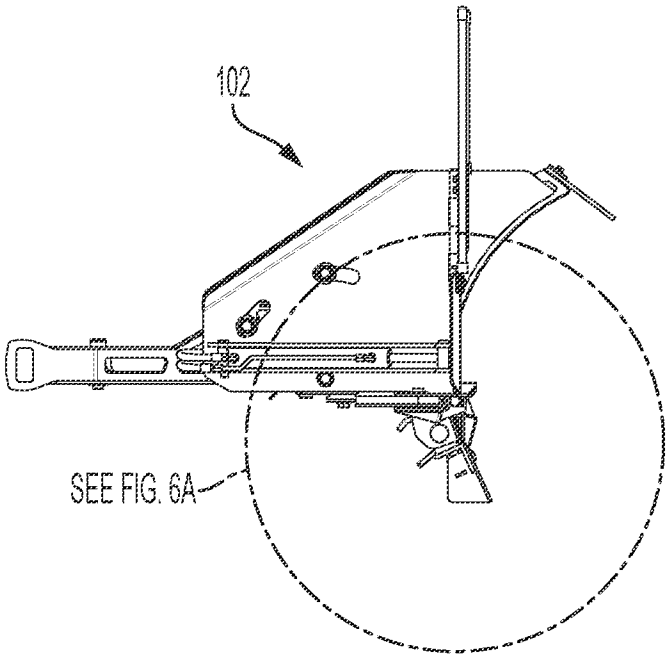
FIG. 6 is a side elevational view of the side panels as shown in FIG. 5.
Figure 7A:
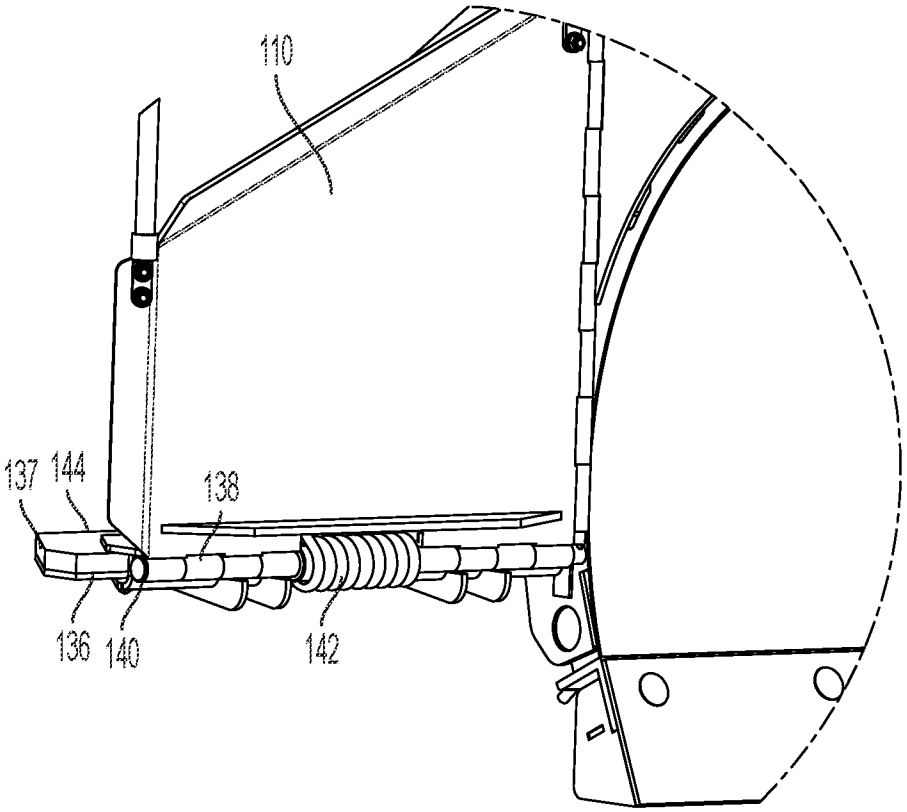
FIG. 7A is an enlarged, front perspective view of the side panel of FIG. 7.
Figure 7:
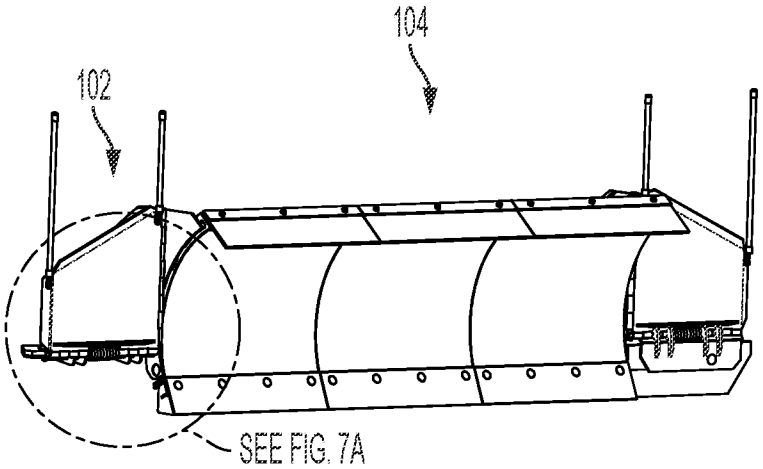
FIG. 7 is a front perspective view of the side panels as shown in FIG. 5.
Figure 7B:
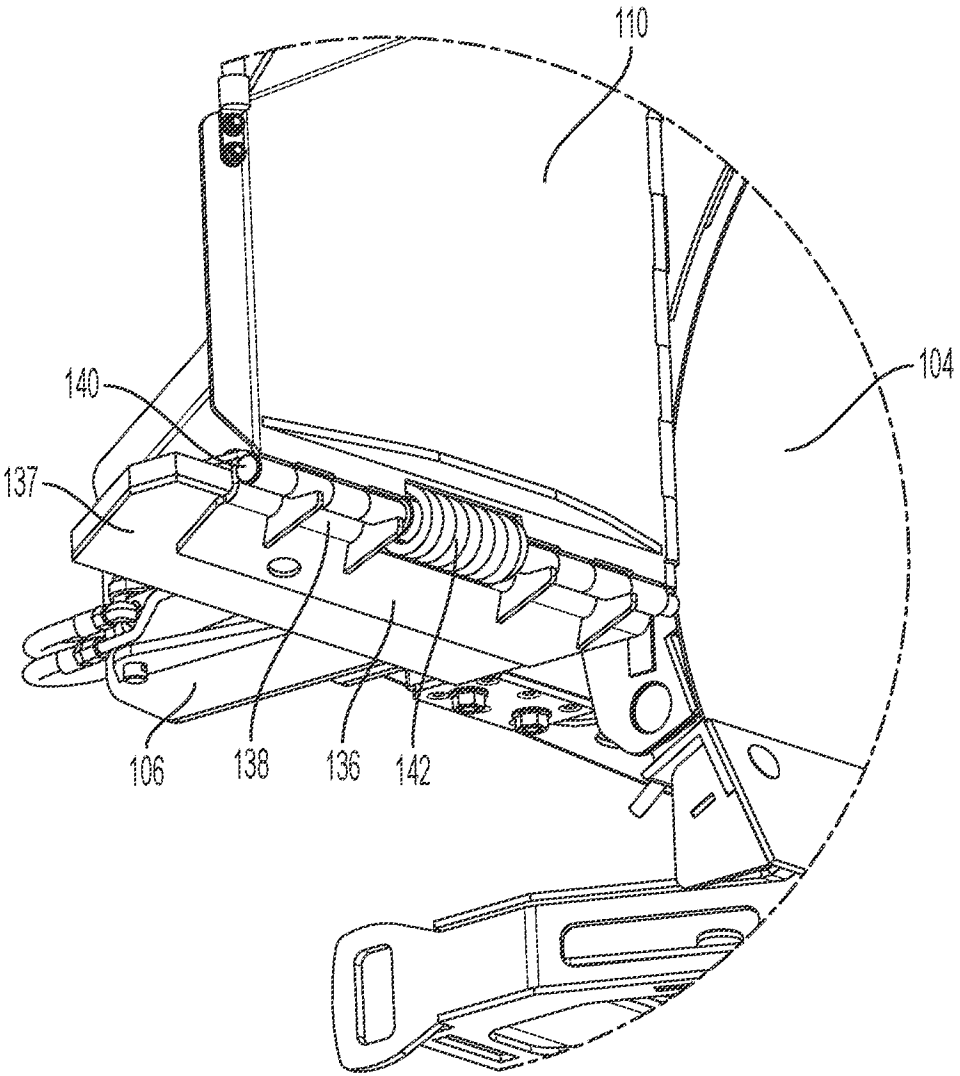
FIG. 7B is an enlarged, bottom perspective view of the side panel of FIG. 7.

Referring to FIGS. 5 and 5A, the main panel 110 attaches to the main frame 106 about a vertical hinge 124 adjacent the snow plow 104. More specifically, an inner vertical edge 126 of the main panel 110 forms a hinged connection 124 at a midpoint along the main frame planar surface 112. Such a hinged connection 124 enables the main panel 110 to move between the fully extended position shown in FIG. 3A and the fully retracted position shown in FIG. 3C. The main panel 110 may be oriented at any point between and/or beyond the fully extended and fully retracted positions. In the illustrated embodiment, the main frame 106 includes an extended surface beyond the hinged connection 124 that matches the contour of the snow plow 104. In various instances, the main panel 110 comprises a solid and/or smooth snow-contacting, forward-facing surface. Such a solid surface mimics the contour of the snow plow 104.

In the illustrated embodiment, the positioning of the main panel 110 relative to the main frame 106 is controlled by a hydraulic cylinder 130.

A first end 132 of the hydraulic cylinder 130 is rotatably attached to the main frame 106 at first mount 160. For example, the first mount 160 may include first and second parallel mount members 162, 164 with a first pivoting rod 165 extending therebetween, and the first end 132 of the hydraulic cylinder 130 may include a bore for receiving the first pivoting rod 165. Similarly, a second end 134 of the hydraulic cylinder 130 is rotatably attached to the main panel 110 at a second mount 170. For example, the second mount 170 may include first and second parallel mount members 172, 174 with a second pivoting rod 175 extending therebetween, and the second end 134 of the hydraulic cylinder 130 may include a bore for receiving the second pivoting rod 175.

In some embodiments, an elongate cavity may be formed on the main panel 110 integral with the second mount 170 for receiving the length of the hydraulic cylinder 130. In other embodiments, the positioning of the main panel 110 relative to the main frame 106 is controlled through suitable means alternative to the hydraulic cylinder 130.

The hydraulic cylinder 130 moves between a fully extended position and a fully retracted position shown best in FIGS. 3A and 3C, respectively. Movement of the hydraulic cylinder 130 corresponds to the extended and retracted positioning of the main panel 110 relative to the main frame 106. The positioning, or mounting, of the hydraulic cylinder 130 rearward of a snow-contacting surface of the snow plow 104 provides for a longer range of travel, corresponding to a greater range of positions for the side panels 102.

Illustrated in FIGS. 4A and 4B, the bottom panel 114 includes a bottom panel frame 136 with a cutting edge 137 replaceably inserted and secured thereto through a pin 139, for example. In various instances, the bottom panel 114 has first and second parallel members 115*a*, 115*b* defining a slot therebetween. The slot is configured to house at least a portion of the cutting edge 137 therein. The cutting edge 137 may be made of any suitable material, including but not limited to a metallic material or a polymeric material, and can be easily replaced if damaged. The bottom panel frame 136 may be comprised of any suitable material including, but not limited to, a metallic material.

Referring to FIGS. 5-7B, the bottom panel 114 connects to the bottom edge 116 of the main panel 110 through a hinged connection 140 having an axis (the bottom panel axis) extending along and/or aligned with the bottom edge 116 of the main panel 110. The bottom panel 114 moves between a vertical position shown in FIGS. 4A and 4B and a horizontal position shown in FIGS. 5-7B.

A spring mechanism 142 biases the bottom panel 114 into the vertical position. The hinged connection 140 enables the bottom panel 114 and the cutting edge 137 attached thereto to move into the horizontal position. In one embodiment, when the bottom panel 114 is in the vertical position, a lowermost edge 144 of the cutting edge 137 is level with a bottom edge 105 of the snow plow 104 when the width of the main frame 110 is parallel to the structural support 108 (i.e., the vertical edge 126 of the main panel 110 is parallel to the Z-axis).

The cutting edge 137 is connected to the bottom panel frame 136 of the bottom panel 114 at the pin 139 and rotates about an axis (the cutting edge axis) of the pin 139 that is transverse to the bottom panel axis. In various instances, the cutting edge 137 is replaceably connected to the bottom panel 114. The cutting edge 137 rotates about the pin 139 in response to striking debris or an object during use.

During use, the cutting edge 137 naturally remains in the vertical position. Stated another way, when no external forces are being applied to and/or experienced by the cutting edge 137, the cutting edge 137 is in the vertical position. When the cutting edge 137 strikes, or encounters, an obstacle or other debris, such pressure biases the bottom panel frame 136 against the spring mechanism 142 and moves the cutting edge 137 toward the horizontal position. Additionally, the cutting edge 137 is configured to rotate about the pin 139 when the bottom panel 114 strikes an obstacle enabling the snow plow 104 and side panel assembly 100 to continue plowing without stopping to address the obstacle or debris or alter the snow plow's current route.

Figure 8A:
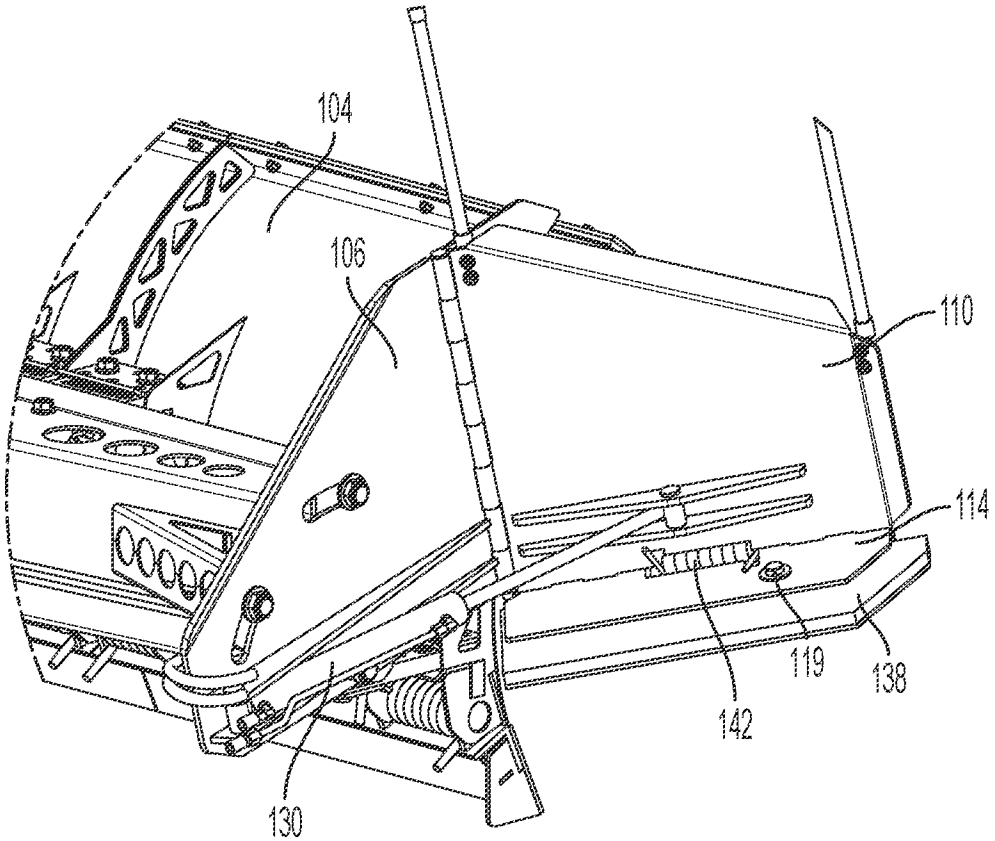
FIG. 8A is an enlarged, top perspective view of the side panel assembly of FIG. 1 showing the first and second side panels in different positions.
Figure 8B:
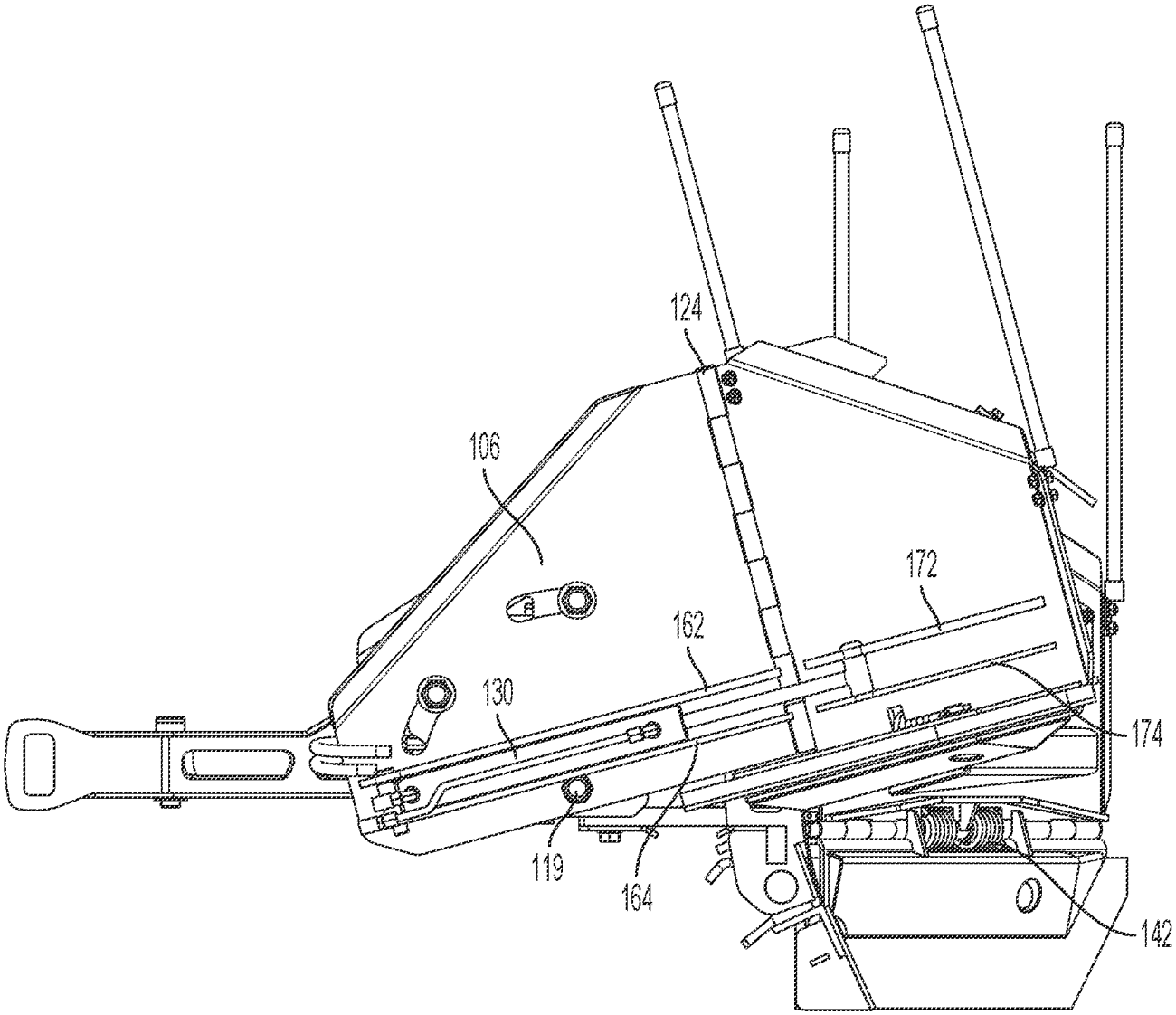
FIG. 8B is an enlarged, side elevational view of the side panel assembly of FIG. 8A.

Further, as shown in FIGS. 8A and 8B, the first and second side panels 102*a*, 102*b* may move to different positions as needed or desired. In at least one instance, the main panel 110 moves relative to the main frame 106, the main frame 106 moves along the threaded rods 122 in the slotted openings 120, the bottom panel 114 moves about the bottom panel axis, and the cutting edge 137 moves about the cutting edge axis, in response to the side panel assembly 100 adjusting to the contour of the ground/road surface. In other instances, such adjustments are controlled by the operator, automated, or controlled by any other suitable means.

In the illustrated embodiment, the side panel assembly 102*a*, 102*b* of the present disclosure is provided on the structural support 108 of the snow plow 104. In other embodiments, the side panel assembly 102*a*, 102*b* can attach to a snow plow 104 that is mounted on any suitable drive vehicle, such as a truck or earth moving equipment.

Various aspects of the subject matter described herein are set out in the following examples.

Example 1—A side panel assembly configured for attachment to a snow plow is disclosed. The side panel assembly comprises a main frame configured to be removably mounted to the snow plow, a main panel connected to the main frame through a vertical hinge, and a bottom panel. The main panel is movable about the vertical hinge between an extended position and a retracted position. The main panel comprises a bottom edge. The bottom panel is connected to the main panel through a horizontal hinge on the bottom edge of the main panel. The bottom panel is movable about the horizontal hinge between a vertical position and a horizontal position.

Example 2—The side panel assembly of Example 1, wherein the horizontal hinge includes a spring mechanism that biases the bottom panel into the vertical position.

Example 3—The side panel assembly of Example 2, wherein the bottom panel is configured to move into the horizontal position when an external force applied to the bottom panel overcomes a biasing of the spring mechanism.

Example 4—The side panel assembly of any one of Examples 1-3, wherein the bottom panel comprises first and second parallel members defining a slot and a cutting edge positioned within the slot.

Example 5—The side panel assembly of Example 4, wherein the cutting edge is rotatably secured to the bottom panel by a pin mechanism configured to enable the cutting edge to rotate about the pin within the slot.

Example 6—The side panel assembly of any one of Examples 1-5, wherein the main frame is rotatably connected to a structural support of the snow plow by a threaded rod.

Example 7—The side panel assembly of Example 6, wherein the main frame comprises a slotted opening configured to receive the threaded rod therethrough.

Example 8—The side panel assembly of any one of Examples 6 and 7, wherein the main frame is rotatable about the threaded rod between an upward facing position and a downward facing position.

Example 9—The side panel assembly of Example 8, wherein the main frame is motivated between the downward facing position and the upward facing position in response to encountering differing topography of a ground surface.

Example 10—The side panel assembly of any one of Examples 1-9, wherein the main panel is motivated between the extended position and the retracted position by a hydraulic cylinder.

Example 11—The side panel assembly of Example 10, wherein the hydraulic cylinder is mounted to the main frame.

Example 12—A side panel assembly configured for attachment to a snow plow is disclosed. The side panel assembly comprises, a main frame configured to attach to a structural support of the snow plow, a main panel rotatably connected to the main frame, a bottom panel rotatably connected to the main panel, and a cutting edge rotatably connected to the bottom panel. The bottom panel is configured to rotate about a bottom edge of the main panel via a spring mechanism.

Example 13—The side panel assembly of Example 12, wherein the main frame is rotatable relative to the structural support between an upward facing position and a downward facing position.

Example 14—The side panel assembly of Example 13, wherein the main frame is motivated between the downward facing position and the upward facing position in response to encountering differing topography of a ground surface.

Example 15—The side panel assembly of any one of Examples 12-14, wherein the main panel is motivated between an extended position and a retracted position by a hydraulic cylinder.

Example 16—The side panel assembly of any one of Examples 12-15, wherein the bottom panel is motivated between a vertical position and a horizontal position by the spring mechanism in response to an external force applied to the bottom panel by an encountered obstacle.

Example 17—The side panel assembly of any one of Examples 12-16, wherein the bottom panel comprises a bottom panel frame configured to replaceably receive the cutting edge therein.

Example 18—The side panel assembly of Example 17, wherein the cutting edge is configured to rotate relative to the bottom panel frame about a pin.

Example 19—A snow plow assembly comprising a snow plow and a side panel assembly is disclosed. The snow plow comprises a plowing surface, a rear surface, and a structural support positioned on the rear surface. The side panel assembly is configured to be replaceably mounted to the snow plow. The side panel assembly comprises a main frame rotatably attached to the structural support of the snow plow, a main panel rotatably connected to the main frame, and a bottom panel rotatably connected to the main panel. The bottom panel is configured to rotate about a bottom edge of the main panel via a spring mechanism. The bottom panel comprises a bottom panel frame configured to replaceably receive a cutting edge therein. The cutting edge is configured to rotate about the bottom panel frame about a pin.

Example 20—The snow plow assembly of Example 19, wherein the main frame is rotatably attached to the structural support of the snow plow by a threaded rod.

Any of the features, functionality and alternatives described in connection with the description provided herein, including Examples 1-20 listed above and/or any one or more of FIGS. 1 to 6, may be combined with any of the features, functionality and alternatives described in connection with any other of FIGS. 1 to 6.

It should be noted that various changes and modifications to the presently preferred embodiments described herein will be apparent to those skilled in the art. Such changes and modifications may be made without departing from the spirit and scope of the present invention and without diminishing its attendant advantages.

What is claimed is:

1. A side panel configured for attachment to a snow plow with an X, Y, Z coordinate system, wherein the X, Y, Z coordinate system includes an X-axis aligned with a width of the snow plow, a Y-axis transverse to the X-axis along a horizontal plane, and a Z-axis aligned with a height of the snow plow, wherein the side panel assembly comprises:

a main frame configured to be removably mounted to the snow plow;

a main panel connected to the main frame through a vertical hinge, wherein the main panel is movable about the vertical hinge between an extended position and a retracted position, and wherein the main panel comprises a bottom edge; and a bottom panel connected to the main panel through a horizontal hinge on the bottom edge of the main panel, wherein the bottom panel is movable about the horizontal hinge, wherein the side panel is simultaneously rotatable relative to the snow plow along the X-axis, the Y-axis, and the Z-axis.

2. The side panel of claim 1, wherein the horizontal hinge includes a spring mechanism that biases the bottom panel into a vertical position.

3. The side panel of claim 2, wherein the bottom panel moves into a horizontal position when an external force applied to the bottom panel overcomes a biasing of the spring mechanism.

4. The side panel of claim 1, wherein the bottom panel comprises first and second parallel members defining a slot, and wherein the bottom panel includes a cutting edge positioned within the slot.

5. The side panel of claim 4, wherein the cutting edge is rotatably secured to the bottom panel by a pin mechanism configured to enable the cutting edge to rotate about the pin within the slot.

6. The side panel of claim 1, wherein the main frame is rotatably connected to a structural support of the snow plow by a first rod and a second rod.

7. The side panel of claim 6, wherein the first rod extends through a bore within the main frame, wherein the second rod extends through an opening in the main frame, the opening having an arcuate shape, and wherein the main frame pivots about the first rod such that the opening moves about the second rod.

8. The side panel of claim 6, wherein the main frame is rotatable about one of the first rod or the second rod between an upward facing position and a downward facing position.

9. The side panel of claim 8, wherein the main frame moves between the downward facing position and the upward facing position in response to encountering differing topography of a ground surface.

10. The side panel of claim 1, wherein movement of the main panel between the extended position and the retracted position is controlled by a hydraulic cylinder.

11. The side panel of claim 10, wherein a first end of the hydraulic cylinder is mounted to the main frame and a second end of the hydraulic cylinder is mounted to the main panel.

12. A side panel configured to a snow plow within an X, Y, Z coordinate system, wherein the X, Y, Z coordinate system includes an X-axis aligned with a width of the snow plow, a Y-axis transverse to the X-axis along a horizontal plane, and a Z-axis aligned with a height of the snow plow, wherein the side panel assembly comprises:

a main frame configured to attach to a structural support of the snow plow;

a main panel rotatably connected to the main frame;

a bottom panel rotatably connected to the main panel, wherein the bottom panel rotates about a bottom edge of the main panel via a spring mechanism; and a cutting edge rotatably connected to the bottom panel, wherein the side panel is simultaneously rotatable relative to the snow plow along the X-axis, the Y-axis, and the Z-axis.

13. The side panel of claim 12, wherein the main frame is rotatable relative to the structural support between an upward facing position and a downward facing position.

14. The side panel of claim 13, wherein the main frame moves between the downward facing position and the upward facing position in response to encountering differing topography of a ground surface.

15. The side panel of claim 12, wherein a hydraulic cylinder controls movement of the main panel between an extended position and a retracted position.

16. The side panel of claim 12, wherein the bottom panel movement between a vertical position and a horizontal position is controlled by the spring mechanism in response to an external force applied to the bottom panel by an encountered obstacle.

17. The side panel assembly of claim 12, wherein the bottom panel comprises a bottom panel frame that replaceably receives the cutting edge therein.

18. The side panel of claim 17, wherein the cutting edge rotates relative to the bottom panel frame about a pin.

19. A snow plow assembly, comprising:

A snow plow within an X, Y, Z coordinate system, wherein the X, Y, Z coordinate system includes an X-axis aligned with a width of the snow plow, a Y-axis transverse to the X-axis along a horizontal plane, and a Z-axis aligned with a height of the snow plow, comprising:

a plowing surface;

a rear surface; and a structural support position on the rear surface; and a side panel configured to be replaceably mounted to the snow plow, wherein the side panel assembly comprises:

a main frame rotatably attached to the structural support of the snow plow;

a main panel rotatably connected to the main frame; and a bottom panel rotatably connected to the main panel, wherein the bottom panel is configured to rotate about a bottom edge of the main panel via a spring mechanism, wherein the bottom panel comprises a bottom panel frame configured to replaceably receive a cutting edge therein, and wherein the cutting edge is configured to rotate about the bottom panel frame about a pin, wherein the side panel is simultaneously rotatable relative to the snow plow along the X-axis, Y-axis, and the Z-axis.

20. The snow plow assembly of claim 19, wherein the main frame is rotatably attached to the structural support of the snow plow by a rod.

* * * * *